US009901238B2

(12) United States Patent
Petri et al.

(10) Patent No.: US 9,901,238 B2
(45) Date of Patent: Feb. 27, 2018

(54) WASHING MACHINE COMPRISING A DE-SCALING APPARATUS

(71) Applicant: Electrolux Professional S.p.A., Pordenone (IT)

(72) Inventors: Biagio Petri, Pordenone (IT); Franco Tassan Mangina, Pordenone (IT); Antonio Asquini, Pordenone (IT)

(73) Assignee: Electrolux Professional S.p.A., Pordenone (IT)

( * ) Notice: Subject to any disclaimer, the term of this patent is extended or adjusted under 35 U.S.C. 154(b) by 639 days.

(21) Appl. No.: 14/471,396

(22) Filed: Aug. 28, 2014

(65) Prior Publication Data

US 2015/0059809 A1 Mar. 5, 2015

(30) Foreign Application Priority Data

Aug. 30, 2013 (EP) ..... 13182424

(51) Int. Cl.
*A47L 15/00* (2006.01)
*A47L 15/42* (2006.01)
*B65D 41/02* (2006.01)

(52) U.S. Cl.
CPC ..... *A47L 15/4231* (2013.01); *A47L 15/0057* (2013.01); *A47L 15/4214* (2013.01); *B65D 41/02* (2013.01); *A47L 2301/08* (2013.01); *A47L 2401/11* (2013.01); *A47L 2501/18* (2013.01)

(58) Field of Classification Search
CPC ..... A47L 15/0057; A47L 15/4214; A47L 15/4231; A47L 2301/08; A47L 2401/11; A47L 2501/18; B65D 41/02; C02F 1/42; C02F 1/4602; C02F 1/485; C02F 5/08; C02F 2201/006; C02F 2303/22; C02F 2307/12
USPC .... 134/56 D, 57 D, 58 D, 104.1, 104.4, 109, 134/183
See application file for complete search history.

(56) References Cited

U.S. PATENT DOCUMENTS

2005/0224100 A1* 10/2005 Maunsell ..... A47L 15/0084 134/56 D
2011/0017235 A1* 1/2011 Berner ..... A47L 15/0002 134/18

* cited by examiner

*Primary Examiner* — Levon J Shahinian
(74) *Attorney, Agent, or Firm* — Pearne & Gordon LLP

(57) ABSTRACT

A washing appliance has a hydraulic circuit including a tank for storing a predetermined amount of liquid, and a heating element inside the tank. The heating element heats the liquid to a predetermined temperature. A water inlet receives water from a water supply network. A descaling apparatus includes a descaler chamber having a housing portion housing a descaler product container containing a descaling agent and a mixing portion containing a mix of water and a predetermined amount of the descaling agent. The housing portion is fluidly connected to the mixing portion and an inlet pipe fluidly connecting a water inlet to the descaler chamber. The descaling apparatus also includes an outlet pipe that drains the mix of water and descaling agent from the mixing portion and provides it to the tank and a spraying element in the mixing portion that sprays water from the inlet pipe towards the housing portion.

16 Claims, 11 Drawing Sheets

WASHING MACHINE COMPRISING A DE-SCALING APPARATUS

The present invention relates to washing appliances, particularly apparatuses for washing dishware. In more detail, the present invention regards dishwashing machines, or dishwashers, for both professional and domestic use, comprising a descaling apparatus adapted to remove limestone deposits and scales accumulations.

A generic dishwasher comprises a hydraulic circuit adapted to receive water from a water supply network and use it, usually together with detergent products and other products—generally referred to as dishwashing products in the following—, such as for example detergent and rinsing aid products for washing and/or rinsing dishware stored in a washing chamber provided in the dishwasher.

In the hydraulic system water from the water supply network may be pumped in predetermined amounts, e.g. determined by a selected washing cycle by a user, in a mixing chamber where water may be mixed with rinsing products and, therefrom, a resulting mix of water and rinsing products—referred to as rinsing liquid in the following—is pumped into a boiler to be heated and then into the spray arms positioned in the washing chamber of the dishwasher, where the rinsing liquid is sprayed by the spray arms over the dishware, rinsing it.

In the washing chamber the rinsing liquid (or plain water if no rinsing products are added) may be mixed with detergent (washing) products (and identified as washing liquid in the following), to this purpose the washing chamber is provided with one or more products compartments in which dishwashing products are stored and from which dishwashing products are ejected during the washing cycle of the dishwasher.

The hydraulic system typically comprises a boiler in which rinsing liquid or water from the water supply network (if no rinsing product is added) is heated up to a predetermined operating temperature (e.g. determined by the selected washing cycle selected), a plurality of pumps and valves for controlling flows of the water and/or the dishwashing products (both separately or mixed together) along pipes of the hydraulic system.

For example, the rinsing liquid being heated in the boiler may be directly pumped into one or more (rotating) spray arms positioned in the washing chamber of the dishwasher to rinse the dishware stored therein during rinsing phase(s) of the selected washing cycle of the dishwasher.

A bottom portion of the washing chamber may comprise, or be fluidly connected to, a drain tank, or sump assembly, where the washing or rinsing liquid is collected and may be discharged through a drain portion of the hydraulic circuit into a sewer network, during the selected washing cycle and particularly at the end thereof.

The hydraulic system may also comprise a recirculating circuit designed to filter, heat and pump the washing liquid collected in the drain tank during the washing cycle back to the spray arms (or to other spray arms provided in the washing chamber as well). In this way, the washing liquid collected in the drain tank is re-used reducing the total amount of water needed for performing the washing cycle.

Unfortunately, during use of the dishwasher, insoluble solid limestone (i.e., calcium carbonate $CaCO_3$) may form (i.e., deposit) within the hydraulic system, other parts of the dishwasher exposed to the washing and/or rinsing liquids (e.g., the washing chamber and the boiler) and also on the dishware within the washing chamber due to calcium ions diluted in the water. Limestone deposition, or encrustation, is exacerbated by the increased temperatures of the washing/rinsing liquid. Indeed, the operating temperatures (e.g., up to 90° C.) of the washing/rinsing liquid reduce the level of carbon dioxide dissolved in the water from the water supply network, which results in calcium ions precipitation with a subsequent limestone deposition.

The limestone deposition on the heating elements of the dishwasher has serious detrimental effects on the lifetime thereof and on their efficiency in terms of absorbed power. For example, limestone deposition on heating resistors (immersed in washing/rinsing liquid during the operation of the dishwasher) used to heat the rinsing water in the boiler of the dishwasher or used to heat washing/rinsing liquid collected in the sump assembly (when the recirculating circuit is provided) reduces the dishwasher performances. Indeed, the limestone deposition on the heating elements reduces a thermal exchange capability thereof. Such reduction in the thermal exchange capability causes an increase in the power consumption and time needed for heating the washing/rinsing liquid to a desired operating temperature and causes an acceleration of wearing out of the heating elements due to an increase of the surface temperature thereof during operation.

Moreover, due to the steep temperature changes (also referred to as thermal shocks), caused by the use of fresh water from the water supply network during a washing cycle, the limestone tends to detach from its deposition site (e.g., from a surface of the heating resistors) as scales. Such limestone scales, or simply scales, may enter into circulation throughout the hydraulic system and obstruct the spray nozzles of the spray arms. Furthermore, the limestone deposition and/or scales accumulation may reduce the cross sections of the pipes, causing a lower flow rate of the washing/rinsing liquid with respect to a flow rate needed by the dishwasher for proper operation. Finally, the pumps of the hydraulic system experiencing limestone deposition and/or scales accumulation on components thereof may increase the power absorption for overcoming the higher weight and friction up to a clogging of the pump, thus sensibly reducing their expected lifetime.

In the art, several of systems and procedures have been developed for reducing the limestone deposition and/or scales accumulation, which are referred to as descaler or delime systems and as descaling or delime procedures, respectively, in the following.

A number of descaler systems and/or descaling procedures have been provided for preliminary treating water in order to lower its hardness (i.e., a water parameter proportional to calcium ions concentration diluted in water). For example, systems implementing water softeners, reverse osmosis, nanofiltratrion and chemical treatments have been proposed in the art to combat limestone deposition and/or scales accumulation. However, the Applicant has perceived that such systems are highly expensive to be implemented and require a regular maintenance in order to operate properly.

Alternatively, in order to reduce and/or remove limestone deposits and/or scales accumulation it is possible to periodically execute a general maintenance of the machine by manually cleaning the individual portions of the hydraulic system (water lines, spray arms, boiler, etc.) with chemical treating agents, typically acid solutions. However, such maintenance requires a qualified technician to be carried out and requires an at least partial disassembly of the dishwasher (e.g., for treating the boiler and the boiler heating resistor).

The chemical treating agents are usually stored in encumbering tanks with a large capacity (e.g. 5 L or even more), which are (externally) connected (by a qualified technician) to a dedicated portion of the hydraulic system for performing a descaling procedure. The European Patent EP 2289385 from the same Applicant discloses an example of such a professional dishwasher.

The International Patent Application No. WO 2011/094852 discloses a dishwasher comprising a softener based on a capacitive-deionization (CDI) cell, in which the hardness ions are extracted, and disposed, still intact, in concentrated form. The softener is combined with a chelate to inhibit precipitation, in the appliance, from the concentrated effluent. The chelate being citric acid, the acidity is effective to keep the hardness ions in solution. The purify and regenerate modes of operation of the softener can be timed to coincide with the washing and rinsing cycles of the appliance, whereby the presence of the softener does not affect the speed and performance of the appliance. The Applicant has found that such a dishwasher has high power and water consumption for performing the softening of washing water every time fresh water is introduced in the hydraulic system and for often descaling the softener in order to have it operate with a substantially constant efficiency.

The Applicant has tackled the problem of devising a satisfactory solution able to provide a dishwasher implementing a simple system adapted to remove limestone deposition and/or scales accumulation, which can be operated by a non-specialized user without any particular technical training and/or knowledge.

The Applicant has found that by implementing a simple additional branch in the hydraulic system and by providing cartridge elements for storing treating agents to be used in the additional hydraulic branch, it is possible to properly prevent and remove limestone depositions without the need to disassemble the dishwasher and/or the intervention of a qualified technician.

One aspect of the present invention proposes a washing appliance for washing items. A washing appliance for washing items is proposed. The washing appliance has a hydraulic circuit comprising at least one tank adapted to store a predetermined amount of liquid, at least one heating element provided at least partly inside said at least one tank adapted to heat said predetermined amount of liquid to at least one predetermined temperature, a water inlet adapted to receive water from a water supply network, and a descaling apparatus. The descaling apparatus comprises a descaler chamber having a housing portion adapted to house a descaler product container containing a descaling agent and a mixing portion adapted to contain a mix of water and a predetermined amount of the descaling agent, the housing portion being fluidly connected to the mixing portion of the descaler chamber and an inlet pipe fluidly connecting the water inlet to the descaler chamber, the inlet pipe being adapted to provide water into the descaler chamber. In the solution according to an embodiment of the present invention, the descaling apparatus further comprises an outlet pipe fluidly connecting the mixing portion and the at least one tank, the outlet pipe being adapted to drain the mix of water and predetermined amount of descaling agent from the mixing portion and provide it to the at least one tank and a spraying element provided in the mixing portion of the descaler chamber and fluidly connected to the inlet pipe, the spraying element being adapted to spray water towards the housing portion.

Preferred features of the present invention are set in the dependent claims.

In an advantageous embodiment of the invention, the descaling apparatus further comprises a valve element provided in the inlet pipe and adapted to selectively allow a flow of water from the water inlet towards the spraying element.

In an advantageous embodiment of the invention, the housing portion of the descaler chamber comprises a support element protruding from an inner wall of the housing portion transversally therefrom, the support element being adapted to support the descaling product container.

In an advantageous embodiment of the invention, the housing portion of the descaler chamber is fluidly connected to the mixing portion of the descaler chamber by means of an aperture therebetween, said aperture being delimited by the support element.

In an advantageous embodiment of the invention, the housing portion of the descaler chamber further comprises a further aperture opposite to the aperture, said further aperture having a size and shape adapted to allow the insertion of the descaling product container into the housing portion.

In an advantageous embodiment of the invention, the washing appliance further comprises a washing chamber adapted to store wares to be treated and the further aperture is exposed on a bottom wall of the washing chamber.

In an advantageous embodiment of the invention, the descaling apparatus further comprises a lid adapted to close the further aperture of the housing portion of the descaler chamber.

In an advantageous embodiment of the invention, the washing appliance further comprises a casing and the further aperture is exposed on a panel of the casing.

In an advantageous embodiment of the invention, the mixing portion further comprises a funnel-shaped manifold fluidly connected to the outlet pipe.

In an advantageous embodiment of the invention, the support element comprises a hollow punching element is provided, the hollow punching element protruding transversally from a free periphery of the support element towards the top aperture. The hollow punching element is adapted to at least partially cut a descaler cap of the descaler product container.

A different aspect of the present invention proposes a descaling product container for the use in the washing appliance. The descaling product container comprises a container body adapted to contain a predetermined amount of a descaling agent, a container neck, a container aperture delimited by the container neck adapted to allowing access to the interior of the container body, and a container cap adapted to seal the container aperture. The container cap is made of a water-soluble material, or of a water-resistant material, and the descaling product container is adapted to be fitted in the housing portion of the descaler chamber.

A different aspect of the present invention proposes a method for operating the washing appliance. The method comprises the following steps. Providing a descaling agent in the descaler chamber. Allowing water from a water inlet into the inlet pipe of the descaling apparatus. Spraying water from the nozzle into the descaler chamber. Mixing together water and the descaling agent in the mixing portion of the descaler chamber in order to obtain a mix of water and of the descaling agent. Transferring the mix of water and of the descaling agent from the mixing portion of the descaler chamber into the at least one tank element through the outlet pipe. Heating the mix of water and of the descaling agent up to a predetermined temperature. Holding the mix of water and of the descaling agent in the at least one tank element for a predetermined reaction time in order to react with limestone deposition and/or scales in the at least one tank element. Discharging the mix of water and of the descaling agent through a drain portion of the hydraulic circuit of the washing appliance.

In an advantageous embodiment of the invention, the step of providing a descaling agent in the descaler chamber comprises fitting the descaling product container in the housing portion of the descaler chamber. Moreover, the step of spraying water from the nozzle in the descaler chamber comprises dissolving the container cap of the descaling product container in order to allow the descaling agent falling by gravity into the mixing portion of the descaler chamber together with the water sprayed by the nozzle. Alternatively, the step of providing a descaling agent in the descaler chamber comprises fitting the descaling product container in the housing portion of the descaler chamber, and at least partly punching the container cap.

In an advantageous embodiment of the invention, the step of providing a descaling agent in the descaler chamber comprises providing the descaling agent unpackaged in the descaler chamber.

In an advantageous embodiment of the invention, the at least one tank comprises a first tank element and a second tank element fluidly connected to each other. Moreover, the step of transferring the mix of water and of the descaling agent from the mixing portion of the descaler chamber into the at least one tank element through the outlet pipe comprises transferring the descaling liquid into the first tank element and providing the mix of water and of the descaling agent in the second tank element. The step of heating the mix of water and of the descaling agent up to a predetermined temperature comprises heating the mix of water and of the descaling agent up to a first predetermined temperature and heating the mix of water and of the descaling agent up to a second predetermined temperature. Furthermore, the step of holding the mix of water and of the descaling agent in the at least one tank element for a predetermined reaction time comprises holding the mix of water and of the descaling agent in the first tank element for a first predetermined reaction time and holding the mix of water and of the descaling agent in the second tank element for a second predetermined reaction time.

These and others features and advantages of the solution according to the present invention will be better understood by reading the following detailed description of some embodiments thereof, provided merely by way of non-limitative examples, to be read in conjunction with the attached drawings, wherein.

Figure 1:
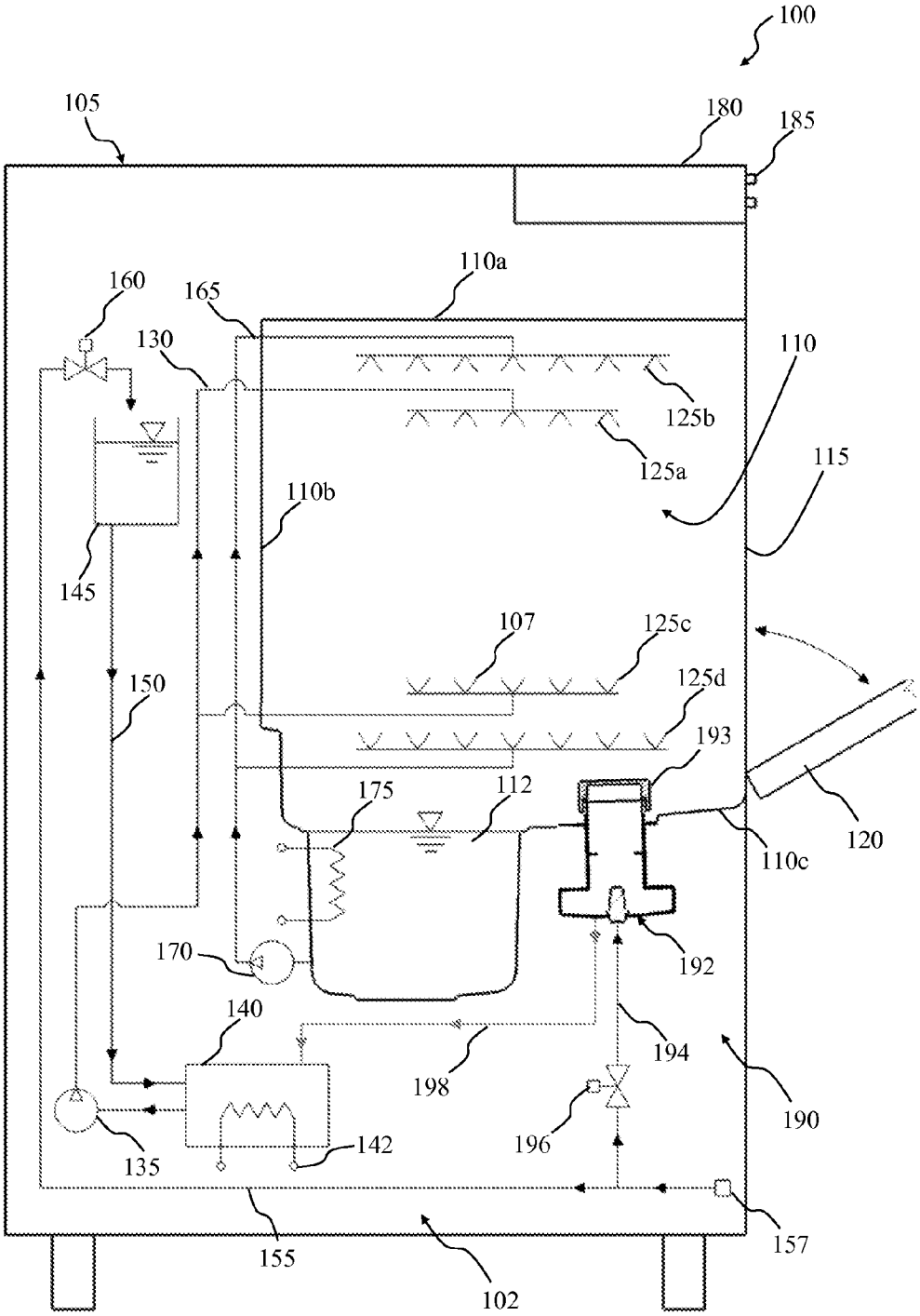
FIG. 1 is a schematic cross-sectional side view of a dishwasher according to an embodiment of the present invention, in which a hydraulic system thereof is outlined.

With reference to the drawings, FIG. 1 is a schematic cross-sectional view of a dishwasher 100 according to an embodiment of the present invention, in which a hydraulic system 102 thereof is schematically outlined. The dishwasher 100 comprises a casing 105, typically parallelepiped-shaped, and preferably made of metal (e.g., stainless steel) and possibly covered by aesthetic panels (not shown). The casing 105 substantially encloses all the other components comprised in the dishwasher 100. A washing chamber 110, preferably substantially parallelepiped-shaped, is provided inside the casing 105 and is adapted to store dishware (not shown) to be washed. Preferably, one or more dishware racks (not shown) may be slidably provided in the washing chamber 110 in order to easily and efficiently store the dishware therein. For example, the dishware racks are adapted to rest on, and slide over a couple of rails (not shown) provided on opposite sidewalls of the washing chamber 100.

In a bottom portion of the washing chamber 110 a drain tank, or sump assembly 112, is provided. The water and/or water mixed with detergent products and/or rinsing products (such as for example cleaning, sanitizing, and/or sparkling aid products), generally referred to as washing or rinsing liquid in the following, respectively, is collected in the sump assembly 112 and may be discharged through a drain portion (not shown) of the hydraulic system 102 of the dishwasher 100 into a sewer network (not shown).

The washing chamber 110 is accessible by a user through a loading/unloading opening 115 provided in a front side of the dishwasher 100 allowing the user to load/unload dishware into/from the washing chamber 110. A door 120 is provided in order to close the loading/unloading opening 115 in a watertight manner. For example, the door 120 and/or the loading/unloading opening 115 are provided with a sealing gasket, not shown, along respective rims thereof that mutually face each other when the door 120 closes the loading/unloading opening 115.

One or more spray arms are provided inside the washing chamber 105 for washing the dishware during the operation of the dishwasher 100. In the example of FIG. 1, four spray arms 125*a*-*d* are provided, two spray arms 125*a* and 125*b* hang from an upper wall 110*a* of the washing chamber 110, preferably rotatably connected to a support projecting from the upper wall towards the center of the washing chamber 110. The other two spray arms 125*c* and 125*d* are preferably rotatably connected to a common, or alternatively two respective, bearing arm(s) (not shown) projecting from a backwall 110*b* in close proximity to a bottom wall 110*c* of the washing chamber 110. Preferably, the spray arms 125*c* and 125*d* are disposed in such a way to be parallel to the spray arms 125*a* and 125*b* and facing towards the center of the washing chamber 110.

The spray arm 125*a* (provided at the upper wall 110*a*) and the spray arm 125*c* (provided at the bottom wall 110*c*), also referred to as rinsing spray arms 125*a* and 125*c* in the following, are fluidly connected to a rinse pipe 130 in which a boiler pump 135 pumps the rinsing liquid, sucked from a boiler 140 positioned upstream the boiler pump 135 and to which the latter is fluidly connected.

The boiler 140 is substantially a watertight tank, or reservoir, comprising a heating element, such as a heating resistor 142, which is selectively energized during the operation of the dishwasher 100 in order to heat the rinsing liquid stored in the boiler 140 up to a predetermined temperature (e.g., defined by a selected washing cycle as known), before the rinsing liquid is pumped towards the spray arms 125*a* and 125*c* and therefrom into the washing chamber 110 for rinsing the dishware.

The rinsing liquid flows into the boiler 140 from a mixing chamber 145 to which is fluidly connected by a mixing pipe 150. Preferably, the mixing chamber 145 is a watertight tank located in an upper position with respect to the boiler 140. In this way, the rinsing liquid in the mixing chamber 145 may reach the boiler 140 simply by gravity (i.e., without the need of a pump or similar device).

Water is introduced into the mixing chamber 145 through a main pipe 155 fluidly connected to the water supply network (not shown) through a water inlet 157. The amount of water introduced into the mixing chamber 145 is controlled by means of a main valve 160 (e.g., a solenoid valve).

In other embodiments according to the present invention, the mixing chamber 145 and the mixing pipe 150 may be omitted, with the main pipe 155, which is directly connected to the boiler 140, and with the mix between water and rinsing products that is performed directly in the boiler 140.

The spray arm 125*b* (provided at the upper wall 110*a*) and the spray arm 125*d* (provided at the bottom wall 110*b*), referred to also as recirculating (or washing) spray arms 125*b* and 125*d* in the following, are fluidly connected to a recirculating pipe 165 in which a recirculating pump 170 pumps washing liquid, sucked from the sump assembly 112 positioned upstream the recirculating pump 170, to which the latter is fluidly connected. In this way, a recirculating circuit that allows consuming reduced amounts of water is implemented. Advantageously, in the sump assembly 112 a heating element, such as another heating resistor 175, is provided in order to heat the washing liquid or the rinsing liquid (if washing products are not mixed with the rinsing liquid in the washing chamber 110) collected in the sump assembly 112 up to the predetermined operating temperature (or to an alternative operating temperature). Preferably, the sump assembly 112 is further provided with a filter arrangement (not shown) adapted to block food scraps and other foreign matter from being sucked by the recirculating pump 170.

The operation of the whole dishwasher 100 is managed by a (electronic) control unit 180 according to washing cycles selected by a user interacting with a control panel 185 of the dishwasher 100. The control unit 180 is configured to operate the main valve 160, the pumps 135 and 170 and the heaters 142 and 175, as well as any other electrically-operable component provided in the dishwasher 100—to which the control unit 180 is electrically connected by means of suitable wiring and, possibly, circuitry, not shown—according to predetermined instructions related to washing cycles selectable by the user, generally stored in a memory device comprised in the control unit 180.

Advantageously, the control unit 180 is positioned inside the dishwasher 100 in a location isolated from water and moisture in order to be not damaged by them. In the example of FIG. 1, the control unit 180 and the control panel 185 are located in a top portion of the casing 105 of the dishwasher 100, even though the control unit 180 and the control panel 185 may be placed in other positions (also spaced apart from each other), such as for example embedded in the door 120.

In an embodiment according to the present invention, the dishwasher 100 further comprises a descaling apparatus 190. The descaling apparatus 190 is now described by making joint reference to FIGS. 1-5.

Figure 3:
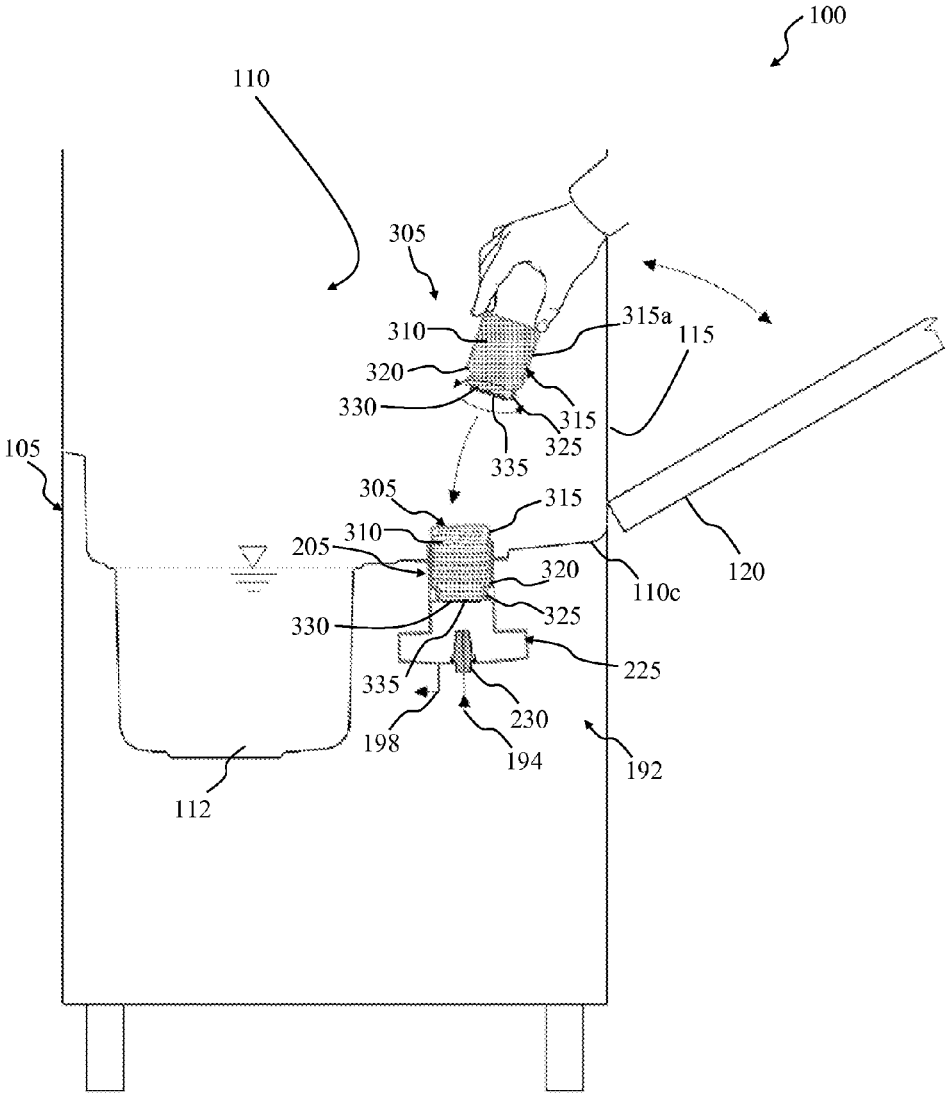
FIG. 3 is a schematic cross-sectional view of a dishwasher wherein a descaler container is being inserted in the descaler chamber according to an embodiment of the present invention.
Figure 4:
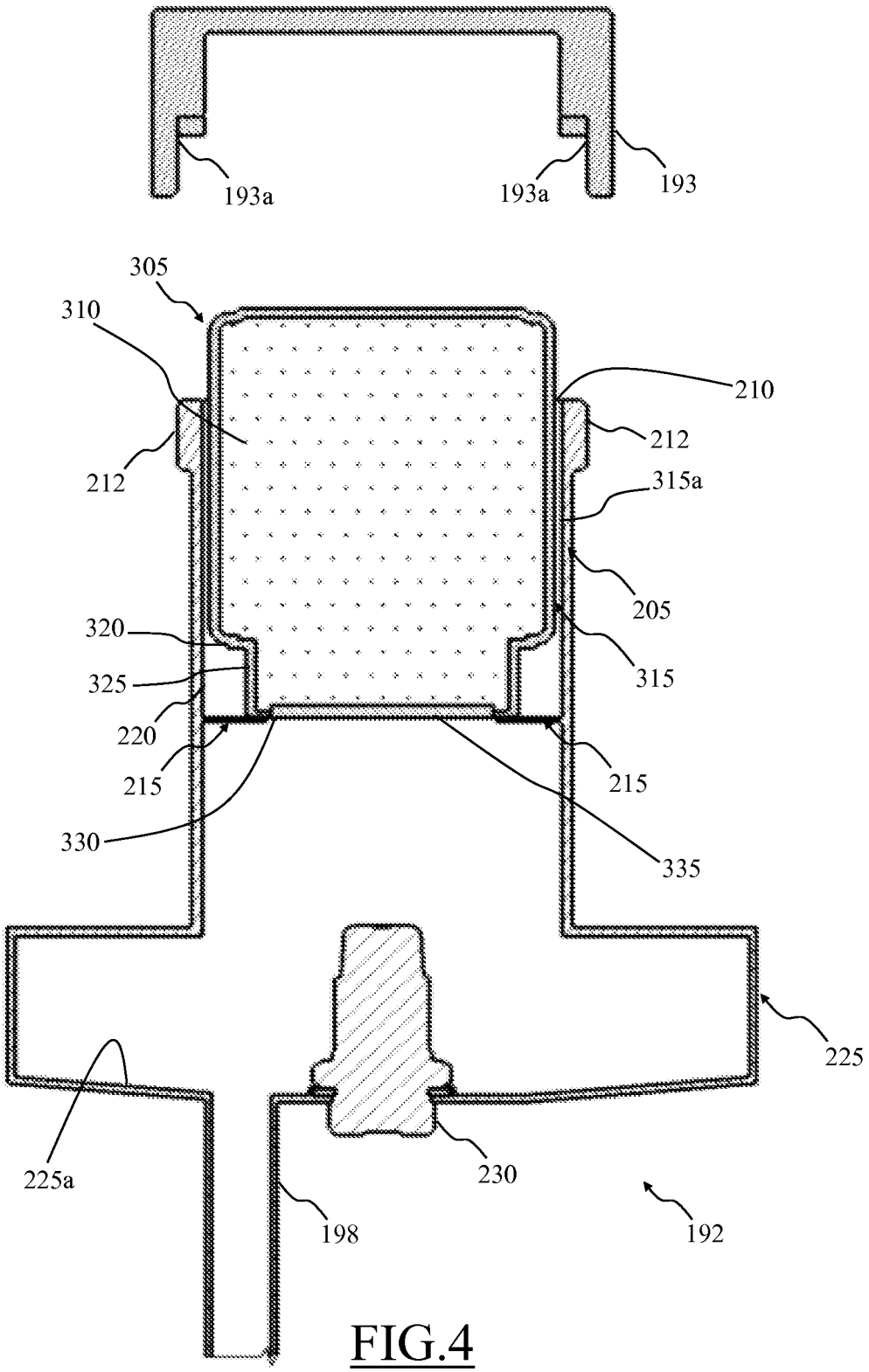
FIG. 4 is a schematic cross-sectional view of a descaler chamber with a descaler container inserted thereinto according to an embodiment of the present invention.
Figure 5:
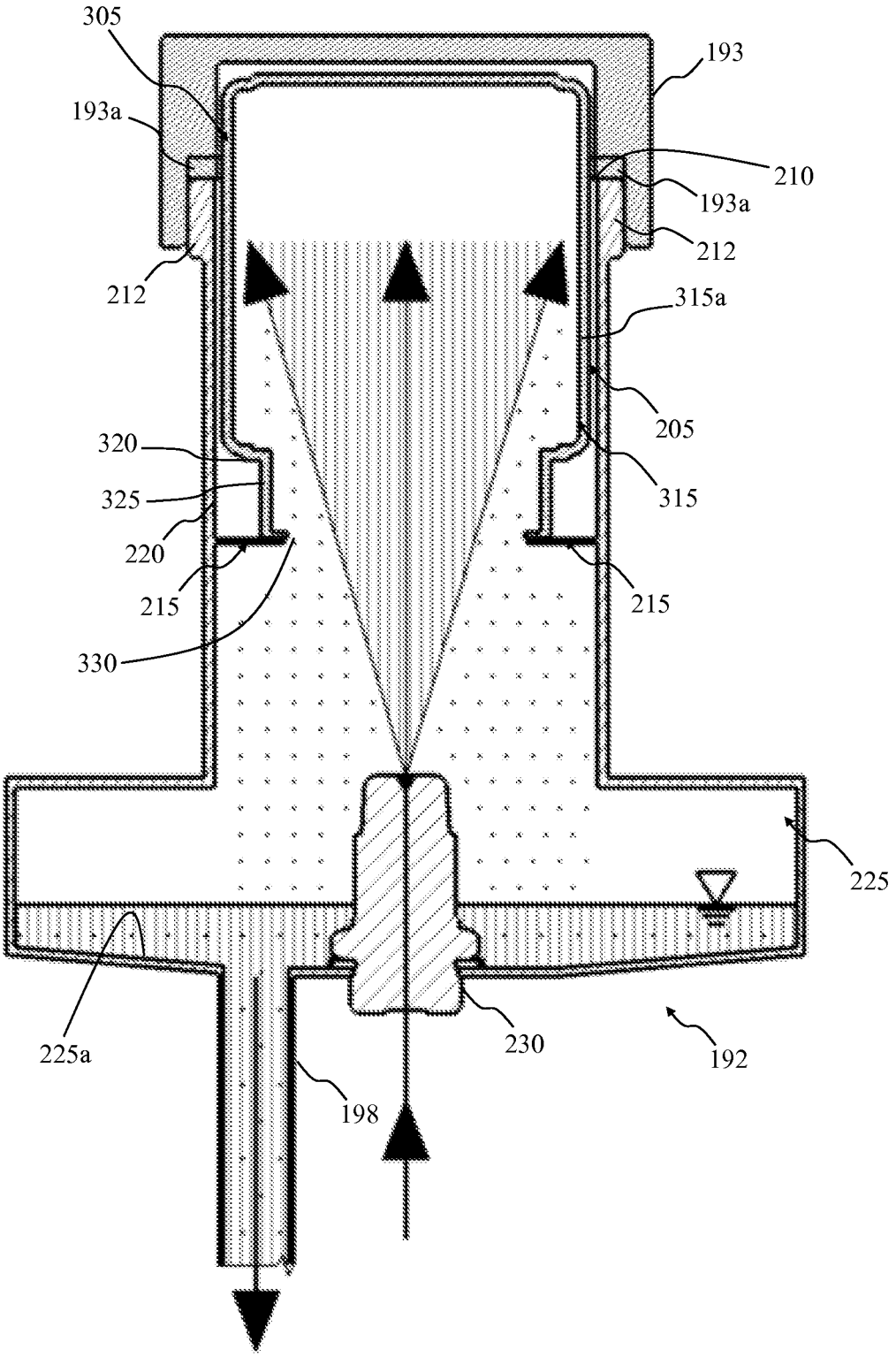
FIG. 5 is a schematic cross-sectional view of a descaler chamber with a descaler container during a mixing of water and descaling agent.

The descaling apparatus 190 according to an embodiment of the present invention is designed to house a suitable descaling product unit or cartridge, such as for example a descaler product container, or simply descaler container 305 (as shown in FIGS. 3-5, and describe in detail in the following), to mix a descaling agent 310 contained in the descaler container 305 with water, thereby obtaining a descaling liquid, and to inject such descaling liquid into the hydraulic system 102 of the dishwasher 100 in order to combat limestone deposition and scales.

The descaling apparatus 190 comprises a descaler chamber 192 closed by a lid 193, an inlet pipe 194 that fluidly connects the main pipe 155 to the descaler chamber 192 passing through a descaler valve 196 (e.g., a solenoid valve) that selectively blocks water incoming therefrom, and an outlet pipe 198 that fluidly connects the descaler chamber 192 with the boiler 140.

Figure 2:
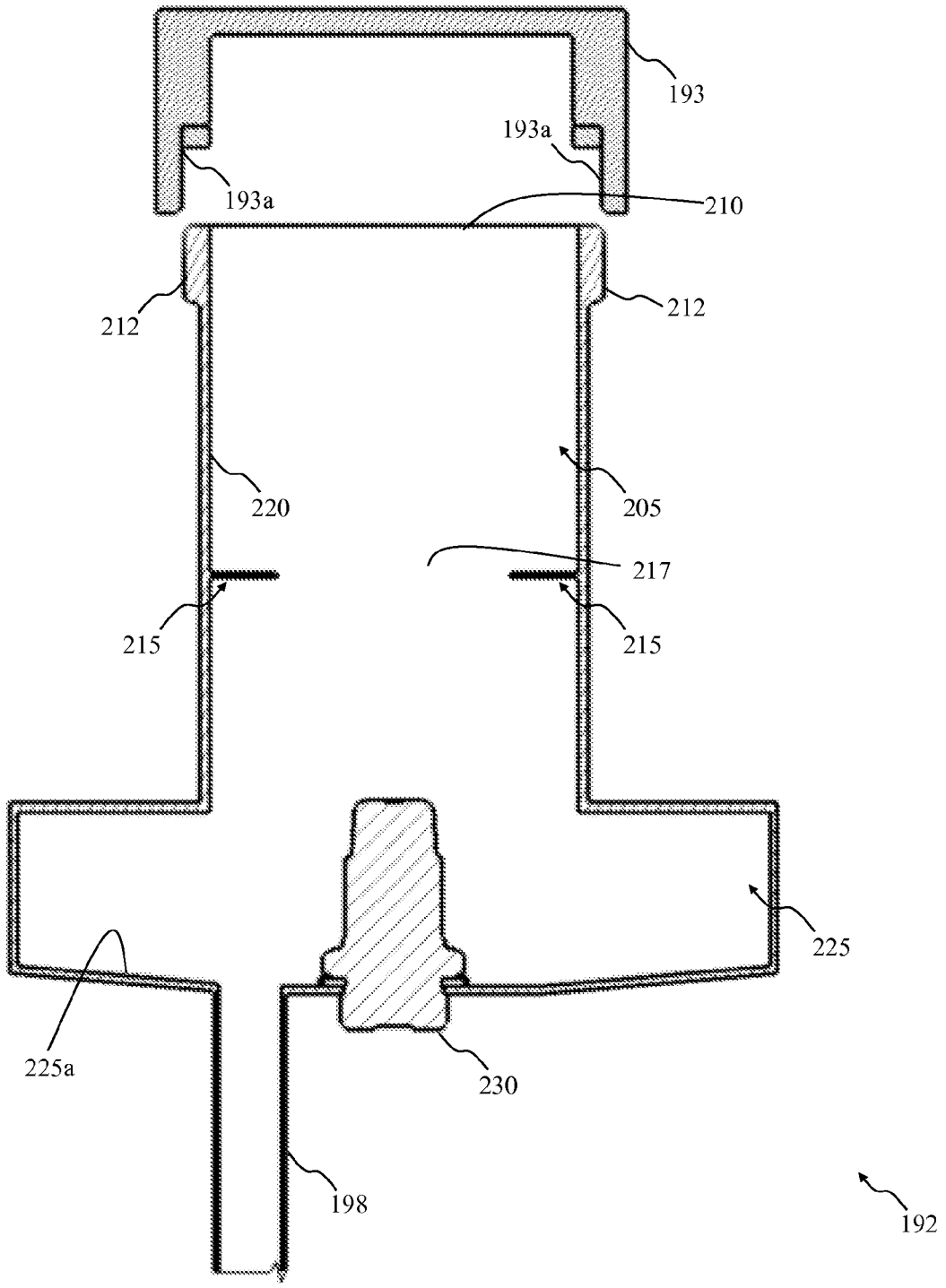
FIG. 2 is a schematic cross-sectional view of descaler chamber according to an embodiment of the present invention.

The descaler chamber 192—as can be best seen in FIG. 2, which is a schematic cross-sectional view of the descaler chamber 192 according to an embodiment of the present invention—preferably comprises a (top) housing portion 205 adapted to house the descaler container 305. For example, the housing portion 205 has substantially a shape adapted to house the descaler container 305 (e.g., cylindrical even though prism-shaped alternative housing portions are not excluded, for housing correspondingly prism-shaped containers).

Preferably, the housing portion 205 comprises a top aperture 210 that, in the example at issue, opens on the washing chamber 110 in a portion of the bottom wall 110*c* thereof, e.g. next to the sump assembly 112. The top aperture 210 is preferably provided close to the loading/unloading opening 115 of the washing chamber 110 in order to be easily reachable by a user (as described in detail later on). Preferably, the top aperture 210 may be selectively sealed by means of the, preferably removable, lid 193 that is adapted to isolate the descaler chamber 192 from the washing chamber 110 (when in closed position), preferably in a watertight manner. Preferably, on a rim 212 of the housing portion 205 that delimits the top aperture 210 engage elements (not visible in the figures) are provided, such as for example a threading or bayonet mounting receptacles (even though other types of engaging elements are not excluded). Such engage elements are adapted to engage with corresponding engage elements (not visible in the figures) provided in a engaging recess 193*a* of the lid 193, when the lid 193 is coupled to the rim 212 of the housing portion 205 in order to close the top aperture 210.

In alternative embodiments of the present invention (not shown in the figures), an alternative lid is hinged to the rim delimiting the top aperture of the housing portion of the descaler chamber.

The housing portion 205 is adapted to receive the descaler container 305 (as described in the following). At a lower end of the housing portion 205 (opposite to the top aperture 210), a support element 215 is provided. The support element 215 protrudes from an inner wall 220 (preferably transversal thereto) of the housing portion 205 and is adapted to support the descaler container 305 once the latter is inserted into the housing portion 205 (as described in the following).

The descaler chamber 192 further comprises a mixing portion 225 beneath the housing portion 205 (preferably formed integral therewith) that is fluidly connected to the mixing portion 225 by means of an aperture 217 delimited by the support element 215. The mixing portion 225 is substantially a tank adapted to contain the descaling agent 310 and a predetermined amount of water (e.g., sufficient for dissolving a descaler powder in the container 305, as described later). A nozzle 230 protrudes from a bottom wall 225*a* of the mixing portion 225, preferably in a central portion thereof, and more preferably aligned with a symmetry axis of the housing portion 205. The spray nozzle 230 is in fluid communication with the inlet pipe 194 of the descaling apparatus 190.

The outlet pipe 198 fluidly connects the mixing portion 225 with the boiler 140, (even if an indirect connection is possible, e.g. by fluidly connecting the outlet pipe with the mixing pipe 150). Preferably, the outlet pipe 198 is connected to the mixing portion 225 at the bottom wall 225*a* thereof.

As can be best appreciated in FIGS. 3-4, which are schematic cross-sectional views of the dishwasher 100 wherein the descaler container 305 is being inserted into the descaler chamber 192 according to an embodiment of the present invention, the descaler container 305 can be easily inserted into the descaler chamber 192 through the top aperture 210 of the housing portion 205 by a user accessing the washing chamber 110 through the loading/unloading opening 115.

Preferably, the descaler container 305 is a vessel-like element adapted to contain a predetermined amount of the descaling agent 310. Advantageously, the descaler container 305 may be sized for containing an amount of the descaling agent 310 needed to perform a single descaling treatment for removing limestone deposit and scales from the hydraulic system 102 of the dishwasher 100. The descaling agent 310 may be in any form adapted for the use in the hydraulic circuit of the dishwasher 100. For example, the descaling agent 310 may be provided in powder form, beads form, liquid form and/or gel form.

The descaler container 305 comprises a container body 315, for example substantially shaped as a hollow cylinder. At one of its ends, the container body 315 has a shoulder portion 320, substantially transversal to sidewalls 315*a* of the container body. A container neck 325 that delimits a container aperture 330 protrudes substantially transversally from the shoulder portion 320 (preferably parallel to the sidewalls 315*a*). Preferably, the shoulder portion 320 of the descaler container 305 may be formed inclined or curved in such a way to ensure a complete outflow of the descaling agent 310 from the descaler container 305 when the latter is inserted into the descaler chamber 192. The container neck 325 and the container aperture 330 preferably have a diameter smaller than a diameter of the container body 315. As can be best viewed in FIG. 4, the container neck 325 is preferably adapted to rest on the support element 215, with the container aperture 330 (and the container cap 325 closing it) substantially aligned with aperture 217 delimited by the support element 215.

Preferably, although not limitatively, the container body 315 is a one-piece element, i.e. the container shoulder 320 and the container neck 325 are formed integral with the rest of the container body 315. The container body 315 is made of a material adapted to store the descaling agent 310 without experiencing leakages, such as for example a plastic polymer (e.g., polyethylene or polystyrene). In an embodiment of the invention, the descaler container 305 is adapted to be re-usable.

The container aperture 330 is sealed by a container cap 335 adapted to seal the descaling agent 310 in such a way to prevent any possibility of direct contact between the descaling agent 310 inside the container body 315 and the user handling the descaler container 305. Preferably, although not limitatively, the container cap 335 may be provided in the form of a film of a suitable material adapted to be opened by a jet of water (as described in the following). For example, the container cap 335 may be formed of a water-soluble material (e.g., comprising wax).

The descaler container 305 may be safely and easily inserted (i.e., without the need of any particular training) in the housing portion 205 of the descaler chamber 192 by the user through the loading/unloading opening 115. As shown in FIG. 3, the descaler container 305 is inserted into the housing portion 205, through the top aperture 210 thereof, with the container cap 335 facing downwards (i.e., towards the support element 215 of the housing portion 205), down until the neck 325 reaches the support element 215 (and rests thereon).

Preferably, the lid 193, once it closes the top aperture 210, seals in a watertight manner the descaler chamber 192 with respect to the washing chamber 110 thereabove.

Therefore, the descaler container 305 is housed in the housing portion 205, with the container aperture 330, closed by the container cap 335, facing towards the mixing portion 225 of the descaler chamber 192. Preferably, the container aperture 330 is axially aligned with the nozzle 230 protruding from the bottom wall 225*a* of the mixing portion 225 of the descaler chamber 192, to be hit by a spray from the nozzle 230 (as shown in FIG. 5 and described in the following).

Figure 6A:
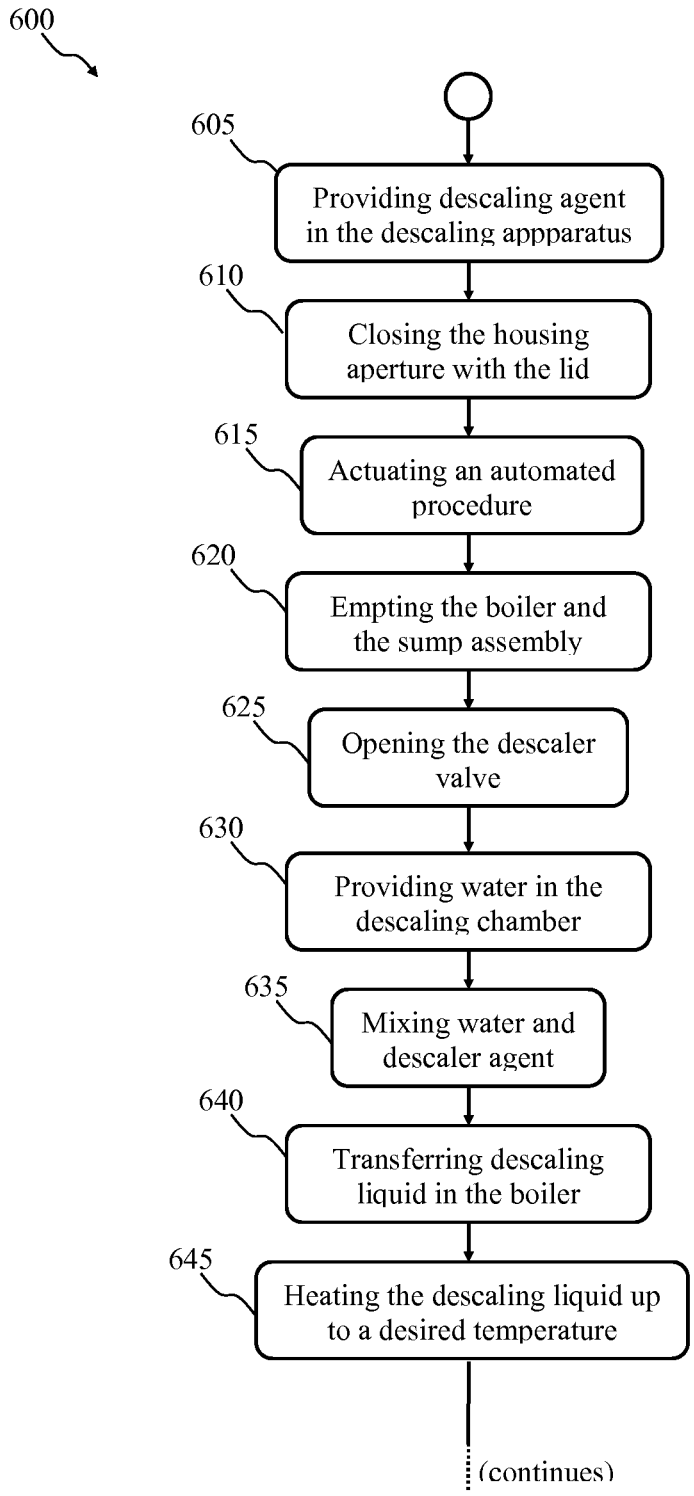
FIGS. 6A-6B are a schematic flow diagram of a descaling procedure according to an embodiment of the present invention.
Figure 6B:
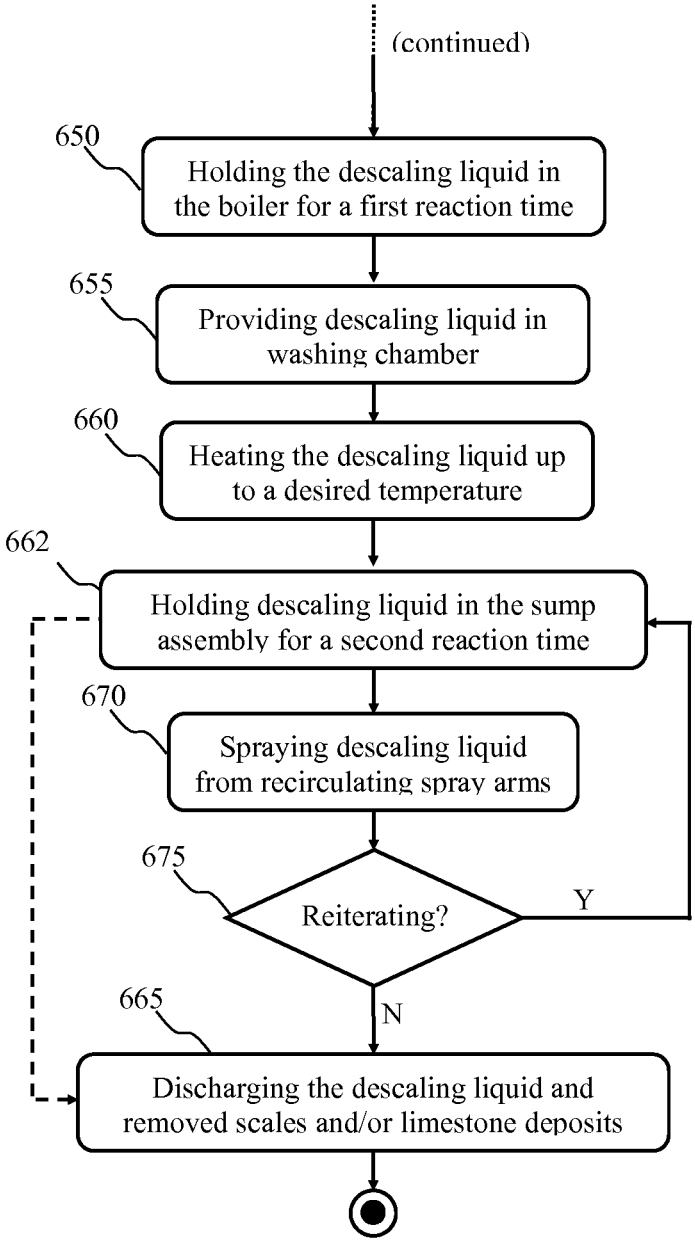

Once the descaler container 305 is housed in the housing portion 205 of the descaler chamber 192, a descaling procedure 600—of which FIG. 6A-6B is a schematic flow diagram according to an embodiment of the present invention—may be started.

Initially, a user places (phase 605) the descaler container 305 inside the housing portion 205 of the descaler chamber 192 and couples (phase 610) the lid 193 with the latter in order to seal the top aperture 210 (as discussed above).

Then, an automated portion of the descaling procedure 600 performed by the dishwasher 100 (e.g., determined by instructions stored in the control unit 180) may be preferably actuated (phase 615) by the user, for example by selecting a corresponding descaling command through the control panel 185 of the dishwasher 100. In alternative embodiments of the present invention, the automated portion of the descaling procedure may be automatically activated by detection (by means of a suitable detection element provided in the dishwasher) of the insertion of the descaler container 305 in the descaler chamber 192 (after the closure of the door 120).

The automated portion of the descaling procedure comprises a complete emptying of the boiler 140 and of the sump assembly 112 (phase 620). Afterwards, the descaler valve 196 opens (phase 625), e.g., upon an electrical command provided by the control unit 180, allowing water from the water supply network into the inlet pipe 194 of the descaling apparatus 190. The water from the inlet pipe 194 is introduced into the nozzle 230, by which it is sprayed (phase 630) towards the descaler container 305. The water sprayed from the nozzle 230 advantageously collides with the container cap 335 dissolving (since the container cap 335 is made of water-soluble material) and/or breaking (thanks to the kinetic energy associated with the spraying) the container cap 335 (as shown in FIG. 5).

Once the container cap 335 is removed by the sprayed water as just described, the descaling agent 310 falls by gravity into the mixing portion 225 of the descaler chamber 192 together with the water sprayed by the nozzle 230. Preferably, the jet of water sprayed by the nozzle 230 may be designed to reach a bottom portion of the descaler container 305 opposite to the container aperture 330. In this way, it is possible to completely empty the descaler container 305, i.e. all the descaling agent 310 stored in the descaler container 305 falls into the mixing portion 225 beneath the support element 215.

Water and the descaling agent 310 mix together (phase 635) in the mixing portion 225 (e.g., the descaling agent 310 dissolves in water) resulting in a liquid mixture referred to as descaling liquid in the following.

The descaling liquid outflows from the mixing portion 225 of the descaler chamber 192 through the outlet pipe 198 and is introduced (phase 640) into the boiler 140. Preferably the valve 196 is maintained open until the liquid level inside the boiler 140 reaches a maximum liquid level allowed. For example, the descaling liquid may flow into the boiler 140 simply by gravity, provided that the descaler chamber 192 is arranged in the dishwasher 100 in a higher position than the position of the boiler 140. Alternatively, a pump (not shown) may be provided in line with the outlet pipe 198 adapted to suck the descaling liquid from the descaler chamber 192 and pump it into the boiler 140.

The descaling liquid in the boiler 140 is heated up (phase 645) by the heating resistor 142 to a predetermined operating temperature, such as for example comprised in range spanning from 70° C. to 80° C. The descaling liquid remains (phase 650) in the boiler 140 for a predetermined first reaction time (defined by the descaling procedure or manually input by the user through the control panel 185) in order to react with limestone deposits and/or scales, removing them from the walls of the boiler 140 and/or from the heating resistor 142 (by dissolving such limestone deposits and/or scales). In this way, it is possible to easily remove limestone deposit and/or scales from the boiler 140 and from its heating resistor 142 which are usually more seriously affected by limestone deposits and scales formation.

In an embodiment of the present invention, once the first reaction time has elapsed, the boiler pump 135 is operated (e.g., by the control unit 180) in order to suck the descaling liquid out from the boiler 140 into the rinse pipe 130 and then the descaling liquid is sprayed by the rinsing spray arms 125*a* and 125*c* into the washing chamber 110 (phase 655)—thereby reacting with, and removing, the limestone deposits and/or scales in the boiler pump 135, in the rinse pipe 130 and on the rinsing spray arms 125*a* and 125*c*. In the washing chamber 110 the descaling liquid removes the limestone deposits and/or scales possibly formed/accumulated on the walls of the washing chamber 110, and is collected in the sump assembly 112.

Preferably, the descaling liquid inside the sump assembly 112 is heated up (phase 660) by the heating resistor 175 to the predetermined operating temperature (e.g., comprised in the range spanning from 70° C. to 80° C., even though different temperatures adapted to peculiar descaling agents are not excluded) and is held (phase 662) inside the sump assembly 112 for a predetermined second reaction time (again, defined by the descaling procedure or by the user through the control panel 185) during which the descaling liquid reacts with, and removes (dissolves), the limestone deposits and/or scales possibly formed/accumulated in the sump assembly 112 and/or on the heating resistor 175.

Afterwards, the descaling liquid with dissolved limestone deposits and/or scales may be discharged (phase 665) through the drain portion of the hydraulic circuit of the dishwasher 100.

In one embodiment of the present invention, the discharging of the descaling liquid is delayed and the recirculating pump 170 is operated (e.g., by the control unit 180) to suck the descaling liquid out from the sump assembly 112 into the recirculating pipe 165 and then the descaling liquid is sprayed (phase 670) by the recirculating spray arms 125*b* and 125*d* into the washing chamber 110—thereby reacting with, and removing, the limestone deposits and/or scales in the recirculating pump 170, in the recirculating pipe 165 and on the recirculating spray arms 125*b* and 125*d*. This phase may be reiterated (phase 675) a predetermined number of times (again, defined by the descaling procedure or by the user through the control panel 185) during the automated portion of the descaling procedure 600, e.g. in order to ensure a complete removal of limestone deposits and/or scales from the washing chamber 110, the sump assembly 112, the heating resistor 175, the recirculating pump 170, the recirculating pipe 165 and the recirculating spray arms 125*b* and 125*d*. Finally, the descaling liquid together with the removed limestone deposits and/or scales are discharged (phase 665) through the drain portion (not shown) of the hydraulic circuit of the dishwasher 100 (ending the automated portion of the descaling procedure).

Thanks to the descaler apparatus 190 and the descaling procedure 600 just described, it is possible for any untrained user to easily remove limestone deposits and/or scales from substantially the whole hydraulic circuit of the dishwasher 100. Moreover, thanks to the descaler container 305 according to embodiments of the present invention it is possible for any untrained user to safely handle the descaling agent 310.

Figure 7:
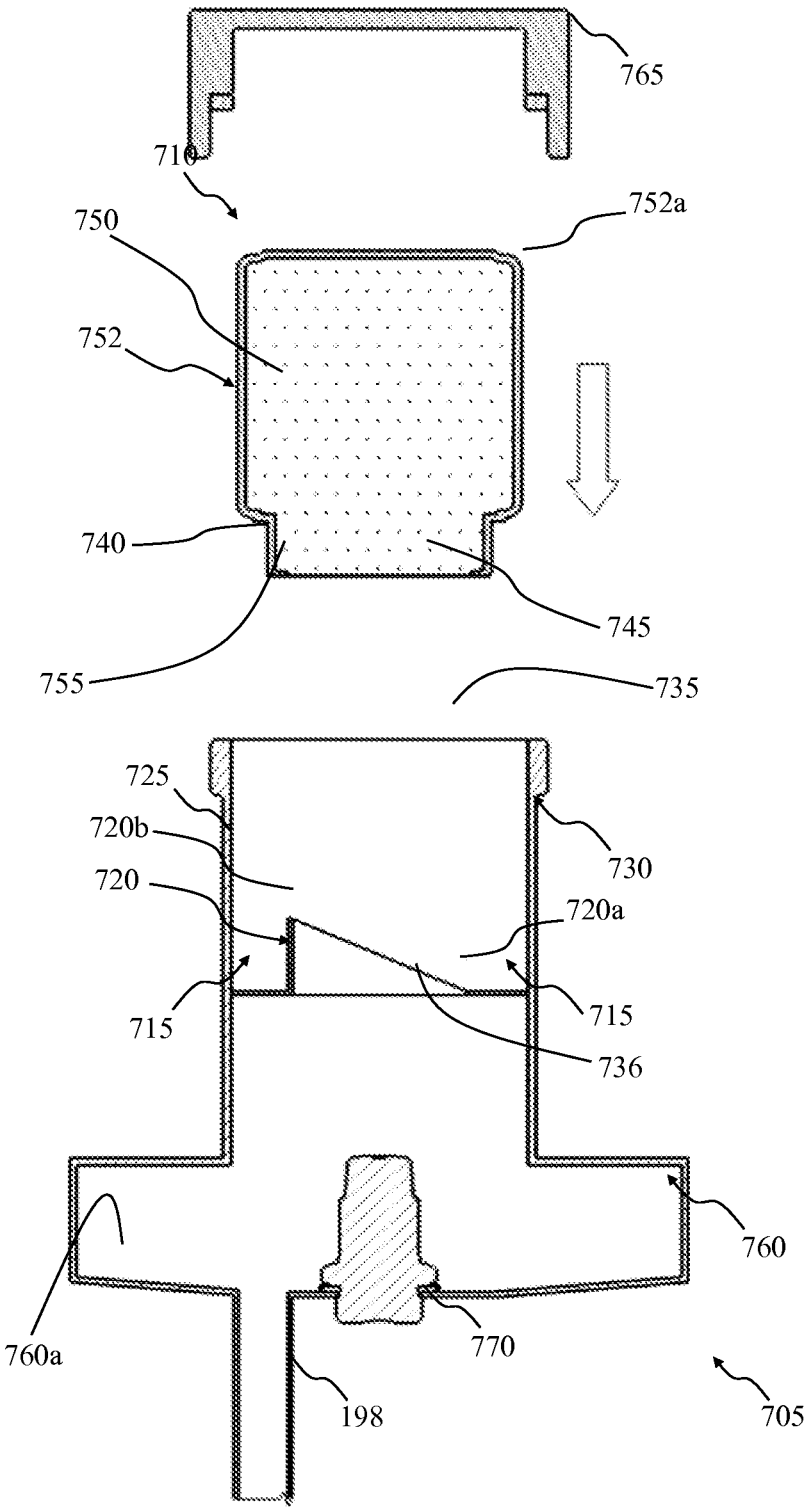
FIGS. 7-9 are schematic cross-sectional views of a descaler chamber and of a descaler container according to an alternative embodiment of the present invention.
Figure 8:
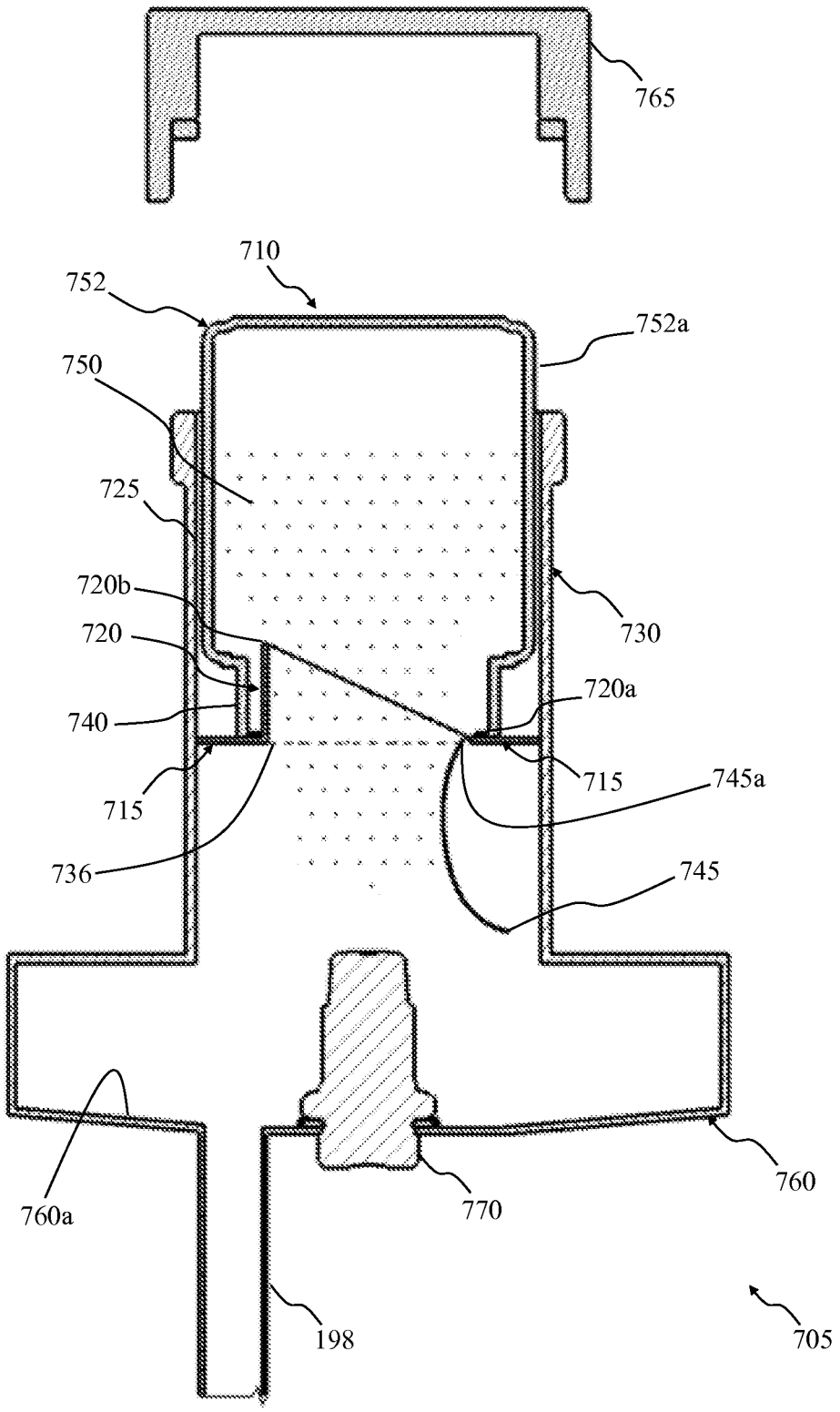
Figure 9:
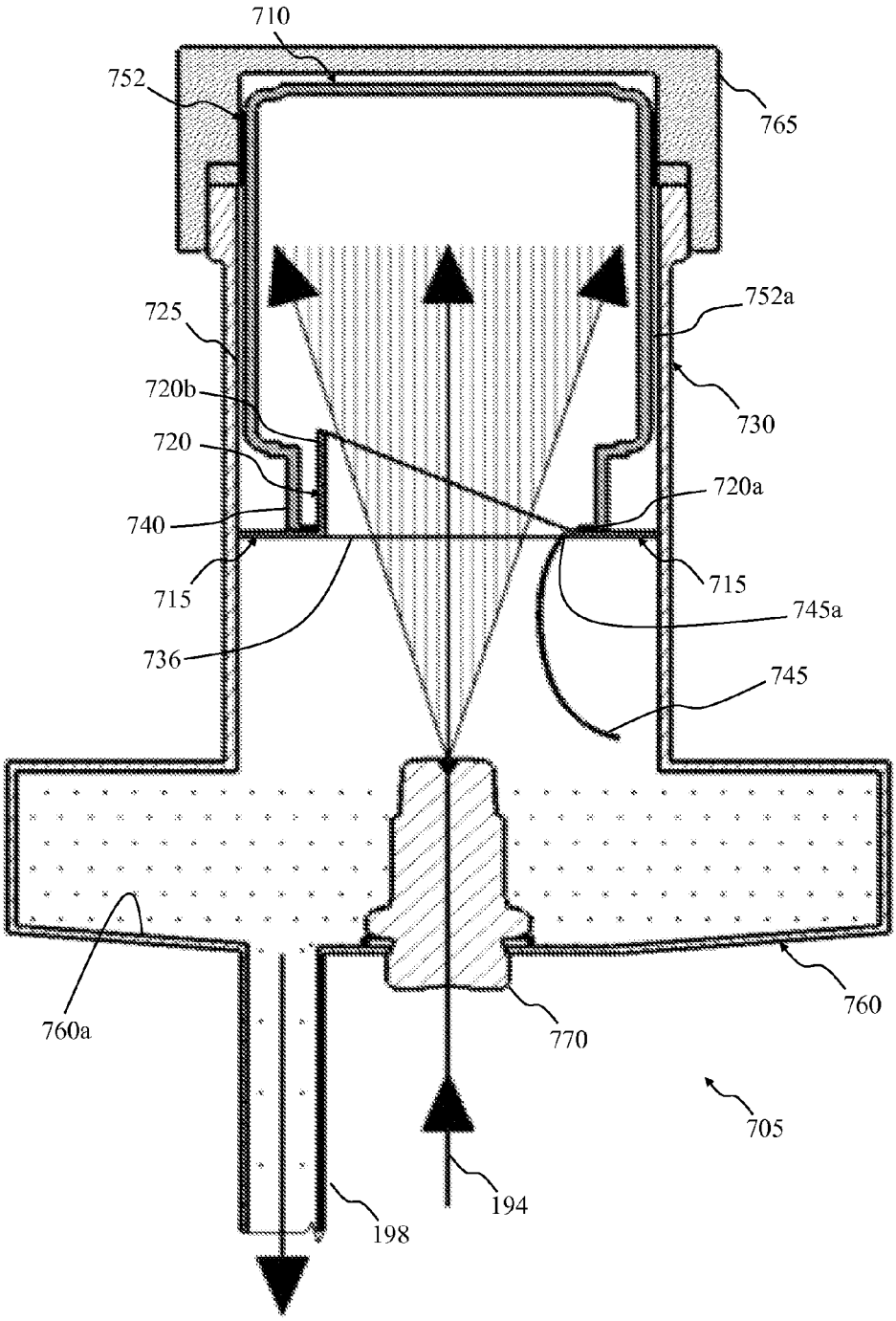

Reference will now be made to FIGS. 7-9, which show a (alternative) descaler chamber 705 and a (alternative) descaler container 710 according to an alternative embodiment of the present invention.

The descaler chamber 705 and the descaler container 710 differ from the descaler chamber 192 and from the descaler container 305, respectively, in what follows.

From a free periphery of the support element (differentiated with the reference 715 in FIGS. 7-9) of the descaler chamber 705 a hollow punching element 720 is provided. Advantageously, the hollow punching element 720 protrudes from the free periphery of the support element 715 substantially transversal to the latter (i.e., parallel to inner sidewall 725 of the housing portion—differentiated with the reference 730 in FIGS. 7-9—of the descaler chamber 705) towards the top aperture (differentiated with the reference 735 in FIGS. 7-9). Preferably, the hollow punching element 720 is made integral with the support element 715. In this embodiment of the present invention, the hollow punching element 720 substantially delimits the aperture (differentiated with the reference 736 in FIGS. 7-9).

Preferably, the hollow punching element 720 has a substantially C-shape in plain view (not shown) and an inclined profile in cross-sectional view. Preferably, the hollow punching element 720 has (in cross-sectional view) low portions 720*a* (corresponding to the tips of the "C", only one of which visible in the figures) flushing with the support element 715 and a top portion 720*b* (corresponding to the bend portion of the "C") protruding from the support element 715 up to a predetermined distance (preferably equal to the length of the container neck—differentiated with the reference 740 in FIG. 7) towards the inside of the housing portion 730. A free end of hollow punching element 720 defines a cutting edge thereof, which is adapted to cut a (alternative) container cap 745 of the descaler container 710.

The container cap 745 of the descaler container 710 is made of a water-resistant material adapted to confine the descaling agent (differentiated with the reference 750 in FIG. 7) within the container. For example, the descaler cap 745 may be made of a foil of aluminum coupled with the container body (differentiated with the reference 752 in FIG. 7), e.g., the descaler cap 745 may be glued to a rim of the container neck 740.

When the user inserts the descaler container 710 in the housing portion 730 of the descaler chamber 705 the cutting edge of the hollow punching element 720 cuts the descaler cap 745. Advantageously, the hollow punching element 720 leaves a sliver of the descaler cap 745 attached to the container neck 740 (i.e., between the lower portions 720*a*), thus preventing the descaler cap 745 to fall into and possibly clog the descaler chamber 705.

Preferably, the hollow punching element 720 has a diameter substantially corresponding to a diameter of the aperture (differentiated with the reference 755 in FIGS. 7-9) of the descaler container 710. Therefore, the hollow punching element 720 cuts the descaler cap 745 close to the container neck 740 of the container body 752. Thanks to the inclined profile of the hollow punching element 720 (described above), a sliver 745*a* of the descaler cap 745 remains attached to the container neck 740. In this way, the weight of the descaling agent 750 within the descaler container 710 makes the descaler cap 745 (between the low portions) pivot on the sliver 745*a* towards the mixing portion (differentiated with the reference 760 in FIG. 7) of the descaler chamber 705. Thus, the descaling agent 750 pours down in the mixing chamber 760 through the container aperture 755. The positioning of the descaler container 710 in the housing portion 730 is completed by closing the top aperture 735 with the cap (differentiated with the reference 765 in FIG. 7). In this embodiment of the present invention, the nozzle (differentiated with the reference 770 in FIG. 7) sprays water in the descaler container 710 thus removing any descaling agent 750 possibly remained inside the descaler container 710, and then falls into the mixing portion 760 where it mixes with the descaling agent 750.

It should be readily apparent to those skilled in the art that the descaling procedure 600 described above may be implemented in dishwasher comprising the alternative descaler chamber 705 and the alternative descaler container 710, without requiring substantial changes to the descaling procedures 600.

Figure 10:
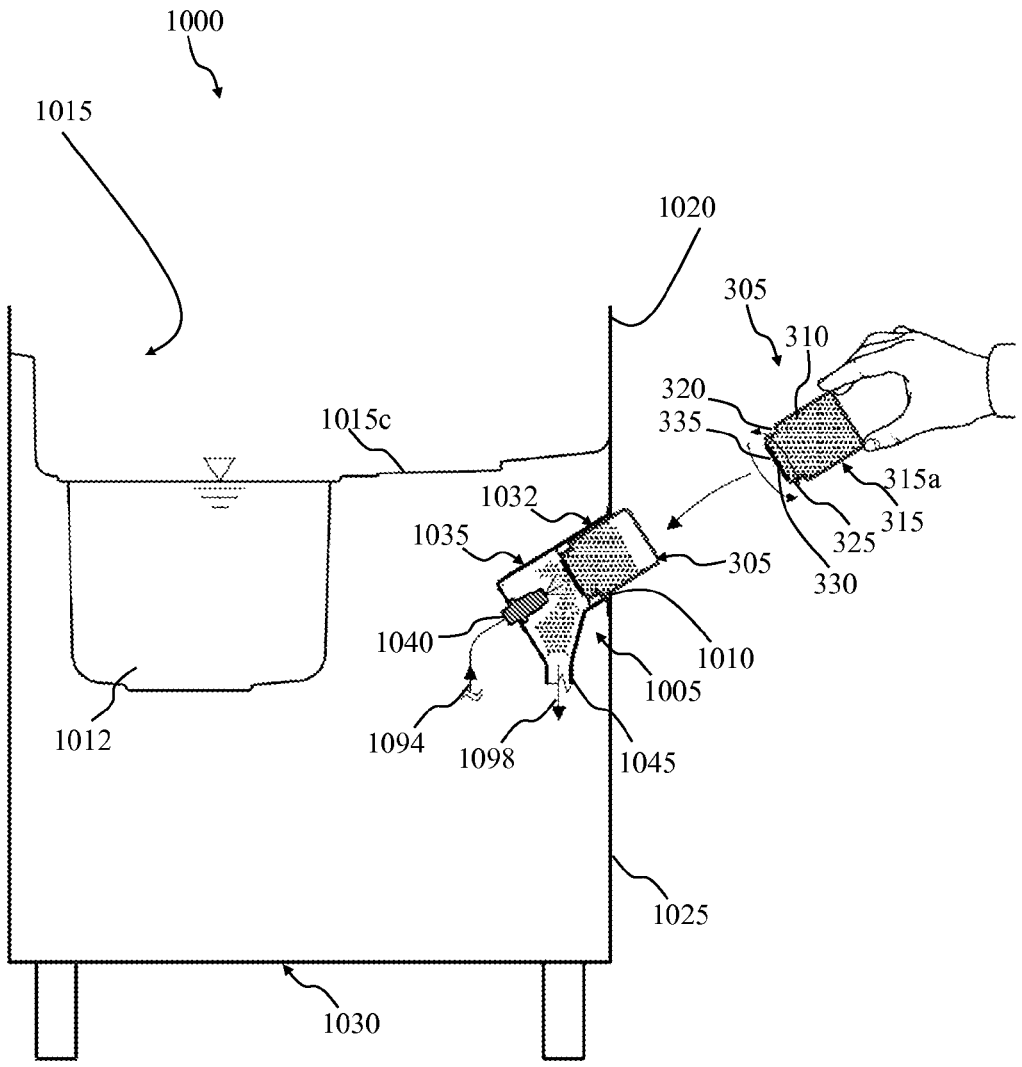
FIG. 10 is a schematic partial cross-sectional view of an alternative dishwasher wherein a descaler container is being inserted into an alternative descaler chamber, according to an embodiment of the present invention.

FIG. 10 is a schematic partial cross-sectional view of a further dishwasher 1000 wherein a further alternative descaler chamber 1005 according to a further embodiment of the present invention is provided adapted to the use with the descaler container 305.

The descaler chamber 1005 differs from the descaler chamber above described in what follows.

The descaler chamber 1005 is positioned in the dishwasher 1000 in such a way that its top aperture 1010 is completely accessible from the outside of dishwasher 1000. Preferably, the descaler chamber 1005 is provided beneath a washing chamber 1015 and a loading/unloading aperture 1020 of the dishwasher 1000. The top aperture 1010 of the descaler chamber 1005 is preferably flush with a front panel 1025 of a casing 1030 of the dishwasher 1000.

In one embodiment of the invention, the descaler chamber 1005 is slanted with respect to a plane defined by the front panel 1025 of the casing 1030. Thanks to such a slanted position of the descaler chamber 1005, the descaling agent 310 in the descaler container 305, once housed in a housing portion 1032 resting on the support element 1034 of the descaler chamber 1005 completely falls in a mixing portion 1035 of the descaler chamber 1005 once a water spray sprayed from a nozzle 1040 removes the container cap 1035 from the descaler container 1005 inserted (similarly as above described) in the housing portion 1032 of the descaler chamber 1005.

Preferably, although not limitatively, the mixing portion 1035 is provided with a manifold 1045, even more preferably substantially funnel-shaped, connected to an outlet pipe (differentiated with the reference 1098 in FIG. 10) in order to feed the descaling liquid to the hydraulic circuit of the dishwasher 1000 (allowing performing the descaling procedure 600 as described above).

The position of the descaler chamber 1005 and of the top aperture 1010 thereof allows an easier insertion of the descaler container 305 in the housing portion 1032 of the descaler chamber 1005, particularly without the need for the user to access the washing chamber 1015.

In order to close the top aperture 1010 of the descaler chamber 1005 a corresponding lid (not shown) may be provided. Preferably, such lid flushes with the front panel 1025 of the dishwasher 1000, once it closes the top aperture 1010 of the descaler chamber 1005. Also in this case the lid may be either a removable lid or a hinged lid.

In a further alternative embodiment of the present invention, a further alternative descaler chamber is provided, analogous to the one just described with reference to FIG. 10 but featuring a hollow punching element protruding from a free end of the support element, thus adapted to be used with the alternative descaler container 710 having a water-resistant container cap 745.

It should be readily apparent to those skilled in the art that the descaling apparatus 190 according to any embodiment of the present invention is also adapted for the use with a descaling agent (either in liquid or solid form) not stored in a container, referred to as unpackaged descaling agent in the following. Indeed, the unpackaged descaling agent may be introduced in the descaler chamber 192, 705, and 1005 manually by the user, in a predetermined amount. Such unpackaged descaling agent once introduced in the descaling chamber 192, 705, and 1005 falls down directly into the mixing chamber 225, 745, and 1035 thereof. After having dispensed the unpackaged descaling agent, the user may close the lid 193, 765 and complete the descaling procedure 600 as above described. In other words, the descaling apparatus 192 is not limited to the use with a descaler container 305, 710, but it is able to correctly operate also with any type of unpackaged descaling agent without requiring any structural changes thereto.

The invention claimed is:

1. A washing appliance (100; 1000) for washing items, having a hydraulic circuit (102) comprising at least one tank (140, 112; 1012) adapted to store a predetermined amount of liquid, at least one heating element (142, 175) provided at least partly inside said at least one tank (140, 112; 1012) adapted to heat said predetermined amount of liquid to at least one predetermined temperature, a water inlet (157) adapted to receive water from a water supply network, and a descaling apparatus (190), the descaling apparatus (190) comprising:

a descaler chamber (192; 705; 1005) having a housing portion (205; 730; 1032) adapted to house a descaler product container (305; 710) containing a descaling agent (310; 750) and a mixing portion (225; 760, 1035) adapted to contain a mix of water and a predetermined amount of the descaling agent (310; 750), the housing portion (205; 730; 1032) being fluidly connected to the mixing portion (225; 760, 1035) of the descaler chamber (192; 705; 1005), and an inlet pipe (194; 1094) fluidly connecting the water inlet (157) to the descaler chamber, the inlet pipe (194; 1094) being adapted to provide water into the descaler chamber (192; 705; 1005), characterized in that the descaling apparatus (190) further comprises:

an outlet pipe (198; 1098) fluidly connecting the mixing portion (225; 760, 1035) and the at least one tank (140, 112; 1012), the outlet pipe (198; 1098) being adapted to drain the mix of water and predetermined amount of descaling agent (310; 750) from the mixing portion and provide it to the at least one tank, and a spraying element (230; 770; 1040) provided in the mixing portion (225; 760, 1035) of the descaler chamber (190) and fluidly connected to the inlet pipe (194; 1094), the spraying element (230; 770; 1040) being adapted to spray water towards the housing portion (205; 730; 1032).

2. The washing appliance according to claim 1, wherein the descaling apparatus (190) further comprises a valve element (196) provided in the inlet pipe (194; 1094) and adapted to selectively allow a flow of water from the water inlet (157) towards the spraying element (230; 770; 1040).

3. The washing appliance (100; 1000) according to claim 1, wherein the housing portion (205; 730; 1032) of the descaler chamber (192; 705; 1005) comprises a support element (215; 715) protruding from an inner wall (220; 725) of the housing portion (205; 730; 1032) transversally therefrom, the support element (215; 715) being adapted to support the product descaler product container (305; 710).

4. The washing appliance (100; 1000) according to claim 3, wherein the housing portion (205; 730; 1032) of the descaler chamber (192; 705; 1005) is fluidly connected to the mixing portion (225; 760, 1035) of the descaler chamber (192; 705; 1005) by means of an aperture (217; 733) therebetween, said aperture (217; 733) being delimited by the support element (215; 715).

5. The washing appliance (100; 1000) according to claim 4, wherein the housing portion (205; 730; 1032) of the descaler chamber (192; 705; 1005) further comprises a further aperture (210; 735; 1010) opposite to the aperture (217; 733), said further aperture (210; 735; 1010) having a size and shape adapted to allow the insertion of the product descaler product container (305; 710) into the housing portion (205; 730; 1032).

6. The washing appliance (100; 1000) according to claim 5, further comprising a washing chamber (110; 1010) adapted to store wares to be treated, and wherein the further aperture (210; 735) is exposed on a bottom wall (110*c*; 1010*c*) of the washing chamber (110; 1010).

7. The washing appliance (100; 1000) according to claim 5, wherein the descaling apparatus (190) further comprises a lid (193; 765) adapted to close the further aperture (210; 735; 1010) of the housing portion (205; 730; 1032) of the descaler chamber (192; 705; 1005).

8. The washing appliance (1000) according to claim 5, further comprising a casing (1030), and wherein the further aperture (1010) is exposed on a panel (1025) of the casing (1030).

9. The washing appliance (100; 1000) according to claim 8, wherein the mixing portion (1035) further comprises a funnel-shaped manifold (1045) fluidly connected to the outlet pipe (1098).

10. The washing appliance (100; 1000) according to claim 3, wherein the support element (715) comprises a hollow punching element (720), the hollow punching element (720) protruding transversally from free periphery of the support element (715) towards a top aperture (735), the hollow punching element (720) being adapted to at least partially cut a descaler cap (745) of the descaler product container (710).

11. The washing appliance (100; 1000) according to claim 1, further comprising a main pipe (155) fluidly connecting the water inlet (157) to a mixing chamber (145), wherein the inlet pipe (194; 1094) is fluidly connected to the main pipe (155) before the mixing chamber (145).

12. The washing appliance (100; 1000) according to claim 1, wherein the descaler chamber (192; 705; 1005) comprises a housing surrounding and defining the housing portion (205; 730; 1032) and the mixing portion (225; 760, 1035).

13. A method (600) for operating the washing appliance (100; 1000) according to claim 1, the method comprising the steps of:

providing (605) the descaling agent (310; 755) in the descaler chamber (192; 705; 1005);

allowing (625) water from the water inlet (157) into the inlet pipe (194; 1094) of the descaling apparatus (190);

spraying (630) water from the spraying element (230) into the descaler chamber (192; 705; 1005);

mixing together (635) water and the descaling agent (310; 755) in the mixing portion (192; 705; 1005) of the descaler chamber (192; 705; 1005) in order to obtain a mix of water and the descaling agent (310; 755);

transferring (640, 655) the mix of water and the descaling agent (310; 755) from the mixing portion (192; 705; 1005) of the descaler chamber (192; 705; 1005) into the at least one tank (112, 140; 1012) through the outlet pipe (198; 1098);

heating (645, 660) the mix of water and the descaling agent (310; 755) up to a predetermined temperature;

holding (650, 662) the mix of water and the descaling agent (310; 755) in the at least one tank (140, 112; 1012) for a predetermined reaction time in order to react with limestone deposition and/or scales in the at least one tank (140, 112; 1012);

discharging (665) the mix of water and the descaling agent (310; 755) through a drain portion of the hydraulic circuit of the washing appliance (100; 1000).

14. The method according to claim 13, wherein the step of providing the descaling agent (310; 755) in the descaler chamber (192; 705; 1005) comprises fitting (605) a descaler product container (305, 710) in the housing portion (205; 730; 1032) of the descaler chamber (192; 705; 1005), the descaler product container comprising:

a container body (315; 752) adapted to contain a predetermined amount of the descaling agent (310; 750);

a container neck (325; 740);

a container aperture (330; 755) delimited by the container neck (325; 740) adapted to allow access to an interior of the container body (315; 752), and a container cap (335; 745) adapted to seal the container aperture (330; 755), wherein the container cap (335; 745) is made of a water-soluble material or a water-resistant material, and wherein the descaler product container (305; 710) is adapted to be fitted in the housing portion (205; 730; 1032) of the descaler chamber (192; 705; 1005) and wherein the step of spraying (630) water from the spraying element (230) in the descaler chamber (192; 705; 1005) comprises dissolving the container cap (335) of the descaler product container in order to allow the descaling agent (310) to fall by gravity into the mixing portion (225; 760; 1035) of the descaler chamber (192; 705; 1005) together with the water sprayed by the spraying element (230; 1040), or wherein the step of providing the descaling agent in the descaler chamber comprises fitting (605) the descaler product container (305, 710) in the housing portion (205; 730; 1032) of the descaler chamber (192; 705; 1005), and at least partly punching the container cap (745) by means of a hollow punching element (720).

15. The method according to claim 13, wherein the step of providing the descaling agent (310; 755) in the descaler chamber (192; 705; 1005) comprises providing the descaling agent (310; 755) unpackaged in the descaler chamber (192; 705; 1005).

16. The method according to claim 13, wherein the at least one tank (140, 112) comprises a first tank element (140) and a second tank element (112) fluidly connected to each other, and wherein the step of transferring (640, 655) the mix of water and the descaling agent (310; 755) from the mixing portion (225; 760; 1035) of the descaler chamber (192; 705; 1005) into the at least one tank (140, 112) through the outlet pipe (198) comprises:

transferring (640) the mix of water and the descaling agent into the first tank element (140);

providing (655) the mix of water and the descaling agent (310; 755) in the second tank element (112), and wherein the step of heating (645, 660) the mix of water and the descaling agent (310; 755) up to a predetermined temperature comprises:

heating (640) the mix of water and the descaling agent (310; 755) up to a first predetermined temperature;

heating (660) the mix of water and the descaling agent (310; 755) up to a second predetermined temperature, and wherein the step of holding (650, 662) the mix of water and the descaling agent (310; 755) in the at least one tank (140, 112) for a predetermined reaction time comprises:

holding (650) the mix of water and the descaling agent (310; 755) in the first tank element (140) for a first predetermined reaction time holding (662) the mix of water and the descaling agent (310; 755) in the second tank element (112) for a second predetermined reaction time.

* * * * *